US005850122A

United States Patent [19]

Winsor

[11] Patent Number: 5,850,122

[45] Date of Patent: Dec. 15, 1998

[54] FLUORESCENT LAMP WITH EXTERNAL ELECTRODE HOUSING AND METHOD FOR MAKING

[75] Inventor: Mark D. Winsor, Olympia, Wash.

[73] Assignee: Winsor Corporation, Seattle, Wash.

[21] Appl. No.: 883,015

[22] Filed: Jun. 26, 1997

Related U.S. Application Data

[63] Continuation of Ser. No. 592,764, Jan. 26, 1996, abandoned, which is a continuation of Ser. No. 416,042, Apr. 4, 1995, Pat. No. 5,509,841, which is a division of Ser. No. 198,495, Feb. 18, 1994, Pat. No. 5,479,069.

[51] Int. Cl.[6] ..... H01J 1/62; H01J 63/04; H01J 17/04; H01J 61/04

[52] U.S. Cl. ..... 313/493; 313/491; 313/631; 313/633; 313/634

[58] Field of Search ..... 313/493, 491, 313/633, 634, 515, 483, 473, 475, 636, 631; 445/26, 25, 43, 44

[56] References Cited

U.S. PATENT DOCUMENTS

| | | | |
|---|---|---|---|
| 1,984,215 | 12/1934 | Hotchner | 176/14 |
| 2,102,049 | 12/1937 | Warren | 313/634 |
| 2,255,431 | 9/1941 | Marden et al. | 176/122 |
| 2,405,518 | 8/1946 | Polevitzky | 176/122 |
| 2,555,749 | 6/1951 | Kreffi | 313/109 |
| 2,733,368 | 1/1956 | Kolkman | 313/109 |
| 2,774,918 | 12/1956 | Lemmers | 315/98 |
| 2,900,545 | 8/1959 | Rulon et al. | 313/108 |
| 3,047,763 | 7/1962 | Inman | 313/109 |
| 3,112,426 | 11/1963 | Carter | 313/634 |
| 3,198,943 | 8/1965 | Pistey | 240/51.11 |
| 3,226,590 | 12/1965 | Christy | 313/109 |
| 3,253,176 | 5/1966 | Pate et al. | 313/204 |
| 3,258,630 | 6/1966 | Scott | 313/109 |
| 3,508,103 | 4/1970 | Young | 313/109 |
| 3,646,383 | 2/1972 | Jones et al. | 313/109 |
| 3,967,153 | 6/1976 | Milke et al. | 313/489 |
| 4,079,288 | 3/1978 | Maloney et al. | 313/489 |
| 4,234,817 | 11/1980 | Teshima et al. | 313/493 |
| 4,245,179 | 1/1981 | Buhrer | 315/248 |
| 4,312,028 | 1/1982 | Hamacher | 362/369 |
| 4,363,998 | 12/1982 | Graff et al. | 313/487 |
| 4,698,547 | 10/1987 | Grossman et al. | 313/485 |
| 4,710,679 | 12/1987 | Budinger et al. | 315/58 |

(List continued on next page.)

FOREIGN PATENT DOCUMENTS

| | | | |
|---|---|---|---|
| 1206553 | 8/1989 | European Pat. Off. | H01J 61/30 |
| 0550047 | 12/1992 | European Pat. Off. | H01J 61/70 |
| 0066495 | 12/1982 | France | 313/634 |
| 39 22 865 A1 | 1/1991 | Germany | H01J 65/04 |
| 0206553 | 8/1989 | Japan | 313/634 |
| 0072552 | 3/1990 | Japan | 313/634 |
| 2 78147 | 3/1990 | Japan | H01J 61/30 |
| 2 244552 | 9/1990 | Japan | H01J 61/72 |
| 3 285249 | 12/1991 | Japan | H01J 61/32 |
| 4 95337 | 3/1992 | Japan | H01J 61/067 |
| 4 147554 | 5/1992 | Japan | H01J 61/30 |
| 2217515 | 10/1989 | United Kingdom | H01J 61/30 |
| WO 92/02947 | 2/1992 | WIPO | H01J 61/30 |

*Primary Examiner*—Sandra O'Shea
*Assistant Examiner*—Mack Haynes
*Attorney, Agent, or Firm*—Seed and Berry LLP

[57] ABSTRACT

A planar fluorescent lamp employing both hot cathode and cold cathode operation is described. The lamp includes a first transparent cover bonded atop a metal body with a serpentine channel therein. The lamp body is coated with an insulative coating and the glass solder bead bonds the cover to the lamp at its perimeter and along the ridges defining the serpentine channel. An alternative embodiment of the lamp includes a second transparent cover bonded above the first transparent cover enabling the fluorescent material to be contained in a second enclosure, isolated from the source of light energy. A second alternative embodiment conceals the electrodes of the lamp beneath the lamp body and provides plasma slots to allow the concealed electrodes to energize the lamp. Another alternative embodiment utilizes a conductive transparent coating on the lamp cover to allow the lamp cover to supplement the lamp body as a cold cathode.

16 Claims, 6 Drawing Sheets

U.S. PATENT DOCUMENTS

| | | | |
|---|---|---|---|
| 4,743,799 | 5/1988 | Loy | 313/493 |
| 4,767,965 | 8/1988 | Yamano et al. | 313/491 |
| 4,772,819 | 9/1988 | Ridders | 313/493 |
| 4,839,555 | 6/1989 | O'Mahoney | 313/493 |
| 4,851,734 | 7/1989 | Hamai et al. | 313/485 |
| 4,899,080 | 2/1990 | Vriens et al. | 313/477 R |
| 4,916,352 | 4/1990 | Haim et al. | 313/25 |
| 4,916,356 | 4/1990 | Ahern et al. | 313/336 |
| 4,916,359 | 4/1990 | Jonsson | 313/489 |
| 4,920,298 | 4/1990 | Hinotani et al. | 313/493 |
| 5,066,257 | 11/1991 | Farner et al. | 445/26 |
| 5,220,249 | 6/1993 | Tsukada | 315/246 |
| 5,319,282 | 6/1994 | Winsor | 313/493 |

FLUORESCENT LAMP WITH EXTERNAL ELECTRODE HOUSING AND METHOD FOR MAKING

CROSS-REFERENCE TO RELATED APPLICATIONS

This application is a continuation of U.S. patent application Ser. No. 08/592,764, filed Jan. 26, 1996, now abandoned, which is a continuation of U.S. patent application Ser. No. 08/416,042, filed Apr, 4, 1995, now U.S. Pat. No. 5,509,841, which is a divisional of U.S. patent application No. 08/198,495, filed Feb. 18, 1994, now U.S. Pat. No. 5,479,069.

TECHNICAL FIELD

The present invention relates to planar fluorescent lamps, particularly planar fluorescent lamps with metal lamp bodies and serpentine channels formed in the lamp body using metal stamping techniques.

BACKGROUND OF THE INVENTION

Thin, planar, durable, easily manufacturable and relatively large area light sources having a range of light intensities are useful in many applications. Such light sources may be useful in backlights for LCDs to improve readability in all ambient lighting situations. They are also commonly used in night vision and avionics applications and, if tiled (i.e., several lamps are positioned adjacently in a two-dimensional matrix), may be useful in sign applications to provide a uniform light source for illuminating a graphic image.

In some applications incandescent lights or LED arrays can be used to form planar light sources. However, these devices typically face the limitations of lack of uniformity of light, high power consumption, and generation of undesirable heat.

An alternative often chosen in modern applications is fluorescent technology. Tubular fluorescent lamps have the advantage of being relatively efficient, generating relatively bright light, and having well-established manufacturing capability. Tubular fluorescent lamps suffer, however, from their fragility, their requirement for optical elements to reflect and diffuse light to provide a uniform display, and limited capability to operate efficiently and effectively in low light applications.

A more desirable technology in many applications is the planar fluorescent lamp. Planar fluorescent lamps are known in the art, having been described, for example, in U.S. Pat. Nos. 3,508,103; 3,646,383; and 3,047,763. Typically, such lamps in the prior art are formed by molding a housing and a cover, each from a piece of glass and sealing the glass pieces to form a sealed enclosure. A selected gas and a fluorescent material are placed in the sealed enclosure for emitting light when an electrical field is applied.

Where the enclosure is formed entirely from glass, fabrication can be difficult and the resulting lamp is often quite fragile. A stronger lamp can be made by using thicker pieces of glass to form a lamp having thicker walls. However, increased glass thickness results in extra weight, is more difficult to fabricate and may attenuate some light output. Further, all forming and annealing is done with heat processing equipment, which is expensive and requires special handling of materials due to the high temperature of processing. Additionally, because such processing requires controlled temperatures during cooling to prevent defects caused by cooling, the process is quite lengthy. These lamps also typically result in operation at higher temperatures than is desirable.

Planar fluorescent lamps having sidewalls formed from metal with a serpentine channel defined by separate strips are known from U.S. Pat. Nos. 3,508,103 and 2,405,518. These lamps require fabrication and assembly of several elements to form the lamp body. Further, after such lamps are assembled and the glass cover is attached, the glass cover is typically not sealed to the tops of the metal strips defining the channels. Consequently, small gaps may remain between adjacent channels which can reduce the overall discharge length of the lamp by permitting the discharge to "shortcut" between adjacent sections of the serpentine channel, rather than following the defined serpentine channel. As is known in the art, a reduced discharge length reduces the overall efficiency of the lamp. Additionally, such an effect causes darkening of those sections of the channel through which the discharge does not travel, thereby reducing the overall uniformity of the lamp. Such a shortcut of the discharge may also cause localized heating which may in turn damage the lamp.

An alternative approach disclosed in U.S. Pat. No. 4,767,965 describes a lamp formed from two parallel glass plates supported by a frame piece. The '965 patent describes a lamp that employs two cold cathode electrodes placed opposite each other. Because the plasma discharge at an optimum mercury vapor pressure conducts current as an arc, it generates light non-uniformly in such a lamp. While the cold cathode electrodes may simplify construction, the lamp described in this patent suffers from brightness variations as great as 60% across the face of the lamp. Additionally, the glass plates used in the lamp must be thick to withstand atmospheric pressure when the enclosure is evacuated.

A need remains, therefore, for a thin, planar lamp having a substantially uniform display which is easily manufacturable, provides a sealed serpentine channel, has a relatively broad range of light intensities, is temperature tolerant, and is relatively durable. Also, such a lamp preferably would provide illumination from out to its periphery, allowing multiple lamps to be tiled.

SUMMARY OF THE INVENTION

According to principles of the present invention, a planar fluorescent lamp includes a metal lamp body having a reflective, insulative coating over an inside surface of the lamp body. A transparent cover is sealed to the lamp body to form an enclosure. The lamp body has a plurality of ridges therein, the ridges defining a serpentine channel covering substantially the entire surface area of the interior. A pair of electrodes is positioned at distal ends of the serpentine channel, within the interior of the lamp. Mercury vapor within the enclosure generates optical energy upon excitation of the electrodes. The lamp also includes a layer of fluorescent material placed in its interior to be excited by optical energy from the mercury vapor and to generate visible light in response.

The ridges are sealed to the transparent cover such that the discharge length of the lamp is substantially the entire length of the serpentine channel. The ridges, with a reflective, insulative layer and the glass solder forming the bond between the ridges and the transparent cover, together form an insulative barrier between adjacent sections of the serpentine channel. This barrier prevents the electrical excitation of the mercury vapor from "shortcutting" between adjacent sections.

In one embodiment, the lamp includes a second transparent cover, substantially aligned with the first transparent cover and together with the first transparent cover forming a second enclosure. In this alternative embodiment, the layer of fluorescent material is within the second enclosure.

In an alternative embodiment, the lamp body includes a terminal permitting the lamp body to be used as a secondary cathode, thereby improving the uniformity of the lamp display. In this embodiment, a transparent, conductive film is placed over the transparent cover overlaying its surface. The conductive film permits the lamp cover itself to be used as one of the secondary cathodes.

In a method of fabrication according to the invention, the lamp body is formed from a single, planar sheet of metal by conventional stamping techniques. Ridges and sidewalls are formed by metal stamping. The lamp body is then coated with the reflective, insulative material using known techniques, such as electrophoresis. Such a coating preferably forms a dense, unbroken, pinhole-free, insulative surface. A glass solder bead is then formed atop sidewalls of the lamp body perimeter and along the ridges. The glass cover is then positioned in contact with the glass solder and bonded to the lamp body by reflowing the glass solder.

A slurry containing the fluorescent material is flowed through the serpentine channel and dried to form the layer of fluorescent material. Then electrodes are inserted through apertures in the lamp body which may be formed during the stamping process, or may be added subsequent to stamping. The electrodes are held in place by a glass solder to seal the enclosure. Mercury is then placed within the lamp in a noble gas environment, such as argon or krypton. The atmospheric pressure within the lamp is established by evacuating the lamp to such that mercury vapor within the lamp reaches a desired partial pressure.

For temperature specific applications, a thermal control element, such as a heater or a heat sink, is bonded to the lamp body or may be formed integrally to the lamp body. The heat sink is preferably bonded directly to the metal lamp body to create a good thermal transfer between the lamp and the heat sink. The reflective, insulative coating overlays the lower surface of the lamp body, the insulative coating on the lower surface is prevented through conventional masking techniques to provide access for such a bond.

DETAILED DESCRIPTION OF THE INVENTION

Figure 1A:
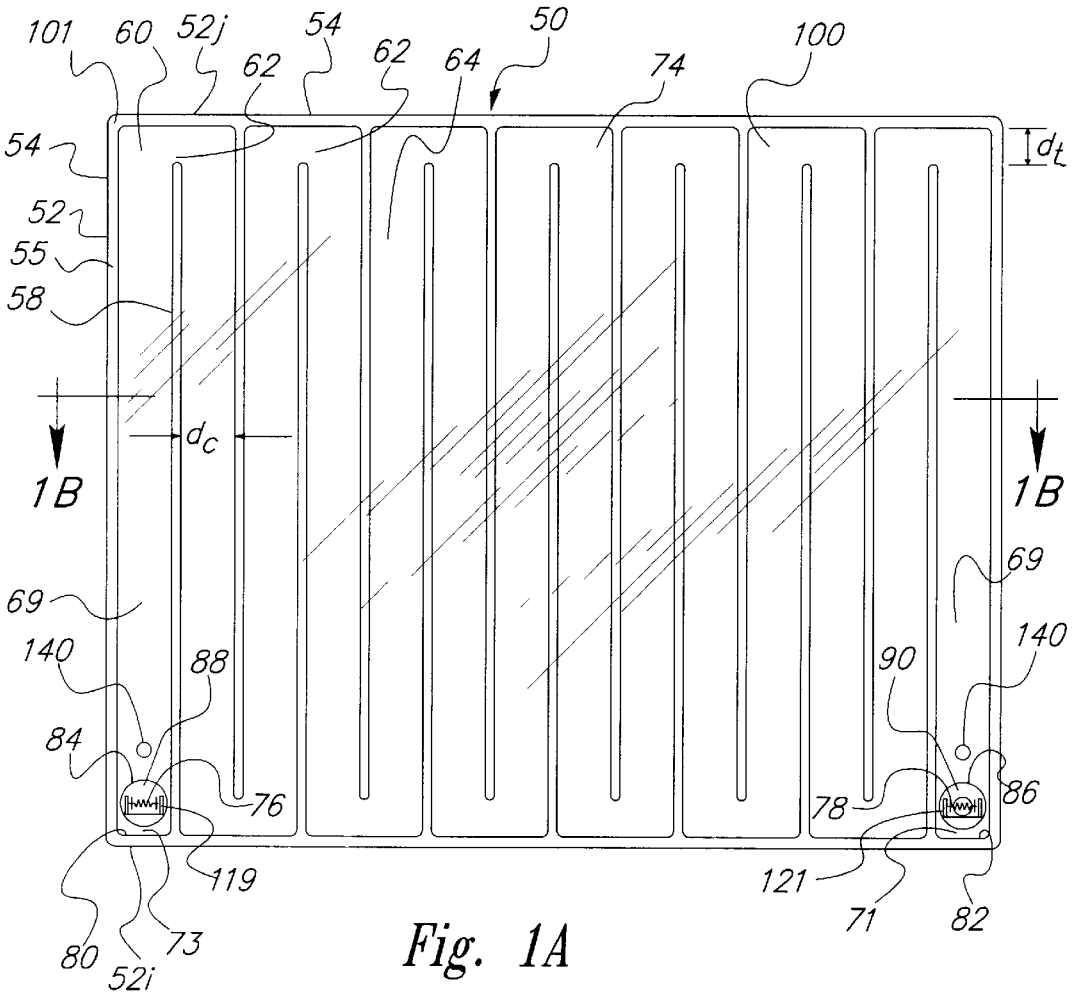
FIG. 1A is a top plan view of an embodiment of the invention.
Figure 1B:
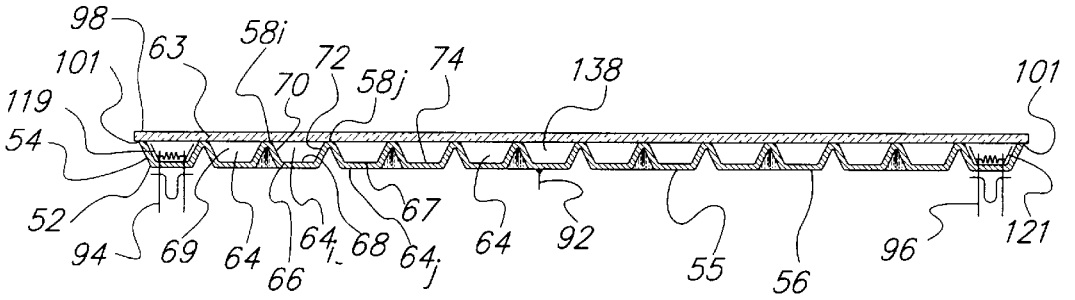
FIG. 1B is a side cross-sectional view of the device of FIG. 1A.

As shown in FIGS. 1A and 1B, a planar fluorescent lamp 50 includes a metal lamp body 52 having sidewalls 54 around its perimeter 55. The lamp body 52 includes planar channel sections 64 with a plurality of ridges 58 formed therebetween. The base 56 covers substantially the area defined by the sidewalls 54. The ridges 58 extend from one of the sidewalls 54 toward the opposite sidewall 54, ending a short distance $d_r$ from the opposite sidewall 52, thereby leaving a gap 62. The upper surface of the base 56 including the ridges 58 defines a serpentine channel 60 having a nominal channel width $d_c$. The serpentine channel thus includes the parallel channel sections 64 and the gaps 62. The distance $d_r$ defining the gap 62 is preferably less than the nominal width $d_c$ of the serpentine channel 60.

As shown by the cross-sectional view of the embodiment of FIG. 1A as presented in FIG. 1B, each of the channel sections 64 includes an inner surface 66 defined by an upper surface 68 of the base 56 and inner surfaces 70, 72 of the ridges 58. The inner surfaces 70, 72 and the sidewalls 54 together form channel walls for the serpentine channel 60.

The upper surface 68 of the base 56 is coated with an insulative coating 74. The insulative coating 74 is preferably highly reflective and is composed of materials such as porcelain enamel. Silicon dioxide films or other diamond-like coatings may be used alternatively. A fluorescent material 106 (shown and described with respect to FIGS. 3A and 3B below) overlays the reflective, insulative layer 74. The fluorescent material 106 is a phosphor coating of a type known in the art.

A cover 98 is bonded to the lamp body 52 forming a contiguous seal around the perimeter 55 and at the intersections of the ridges 58 with the cover 98. The cover 98 and the lamp body 52 together form an enclosure 100. The cover 98 and the serpentine channel 60 also define a sealed passageway 69 having end walls 71, 73. Because the cover 98 is contiguously sealed along the entire length of the ridges 58, gases within the passageway 69 may not travel across the ridges 58. Instead, to travel from one channel section $\mathbf{64}_i$ to the next $\mathbf{64}_j$, gases must travel along the passageway 69 through the respective gap 62.

The cover 98 is a glass having a coefficient of thermal expansion matched to that of the lamp body 52. Other characteristics of the cover 98 will be described more thoroughly below.

A pair of electrodes 76, 78 are positioned within the passageway 69 near the distal ends 80, 82, respectively, of the serpentine channel 60. The electrodes 76, 78 extend into the passageway 69 through respective apertures 84, 86 in the base 56 and are held in place by an insulative bonding material 88, 90, such that the electrodes do not come into electrical contact with the lamp body 52. The insulative bonding material 88, 90 is preferably a glass solder which seals the apertures 88, 90 and allows the entire enclosure 100 to be sealed hermetically. Held within the hermetically sealed enclosure 100 is a mercury vapor 138, preferably in an atmosphere of argon and krypton. The electrodes 76, 78 extend through the insulative bonding material 88, 90 beyond the lower wall 66 to provide access for electrical connection at terminals 94, 96, respectively.

A secondary terminal 92 is attached to the base 56 enabling electrical connection to the base 56. Alternately, the secondary terminal 92 may be connected to ground to help suppress electromagnetic interference or to allow the lamp body 52 to be charged. Charging the metal lamp body 52 advantageously helps to start the lamp when it is in a cold environment, thereby ensuring mercury vapor to protect the hot filaments of the electrodes 76, 78 from getting caught up in a destructive glow discharge mode.

Figure 2A:
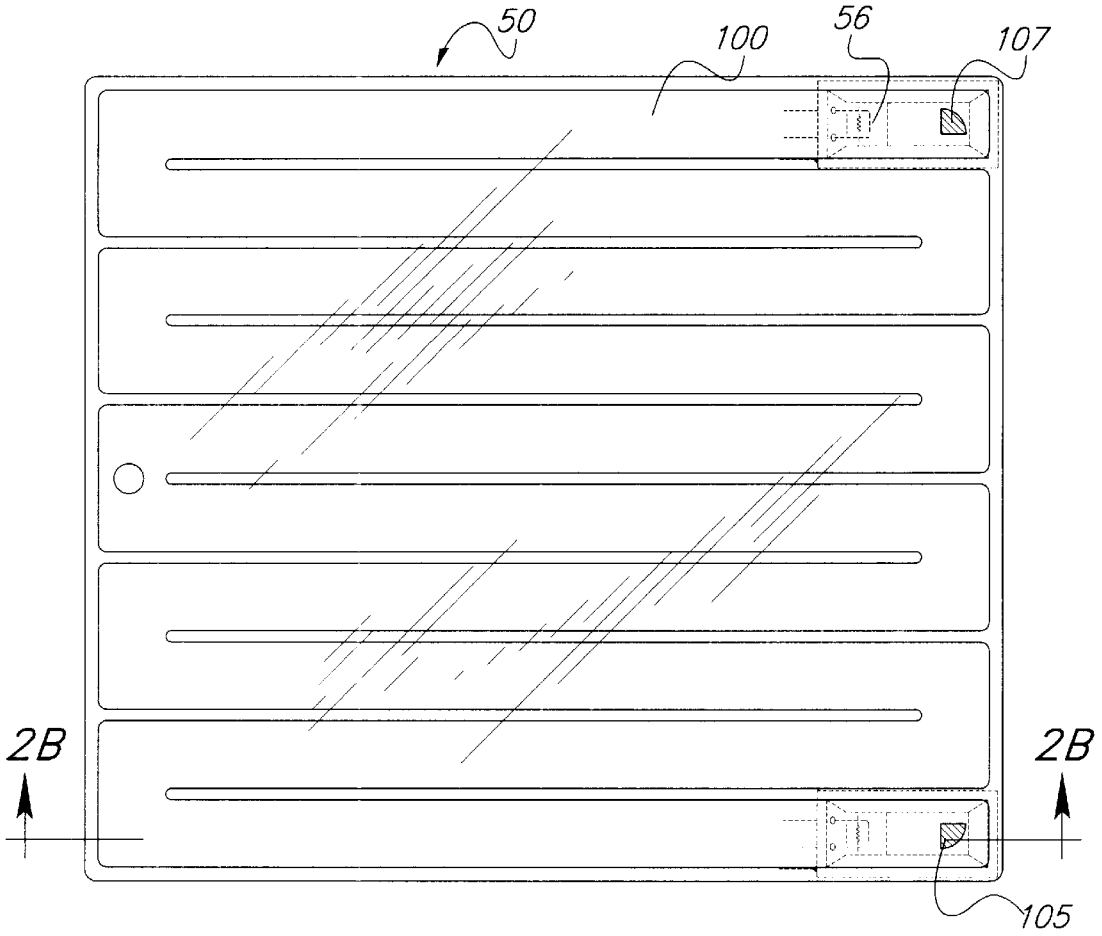
FIG. 2A is a top plan view of an alternative embodiment of the device.
Figure 2B:
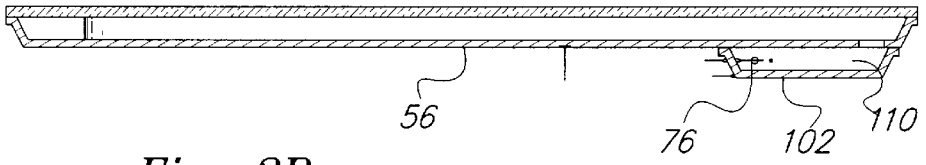
FIG. 2B is a side cross-sectional view of the device of FIG. 2A.
Figure 2C:
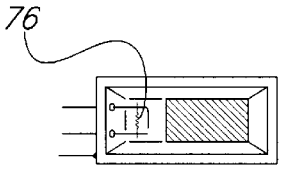
FIG. 2C is a top cross-sectional view showing a portion of the device of FIG. 2A.

An alternative embodiment shown in FIGS. 2A, 2B and 2C is similar to embodiment of FIGS. 1A and 1B except that the electrode 76 and the electrode 78 (shown in hidden lines in FIG. 2A) are positioned below the lower wall 56 such that they are not visible from above. In this embodiment, the electrodes 76, 78 are contained within a sealed housing 102 attached below the base 56. The housing 102 is bonded to the base 56, forming a small enclosure 110. To enable the electrodes 76, 78 to excite a plasma within the lamp 50 (as described below), respective plasma slots 104, 106 are formed in the base 56 (replacing the apertures 84, 86 of the embodiment described above). The plasma slots 104, 106 are small apertures which provide a passageway for gases within the lamp 50 to pass between the enclosure 100 and the small enclosure 110. The positioning of the electrodes 76, 78 beneath the base 56 of this embodiment advantageously conceals the regions around the electrode 76, 78, thereby concealing darkening of the plasma in those regions caused by the presence of the electrodes 76, 78. Because the darkening effect is concealed from view, a more uniform distribution of light from the lamp 50 is provided. This permits light to be emitted across the entire lamp, enabling multiple lamps to be tiled in a matrix to form a large, uniform light source.

Figure 8:
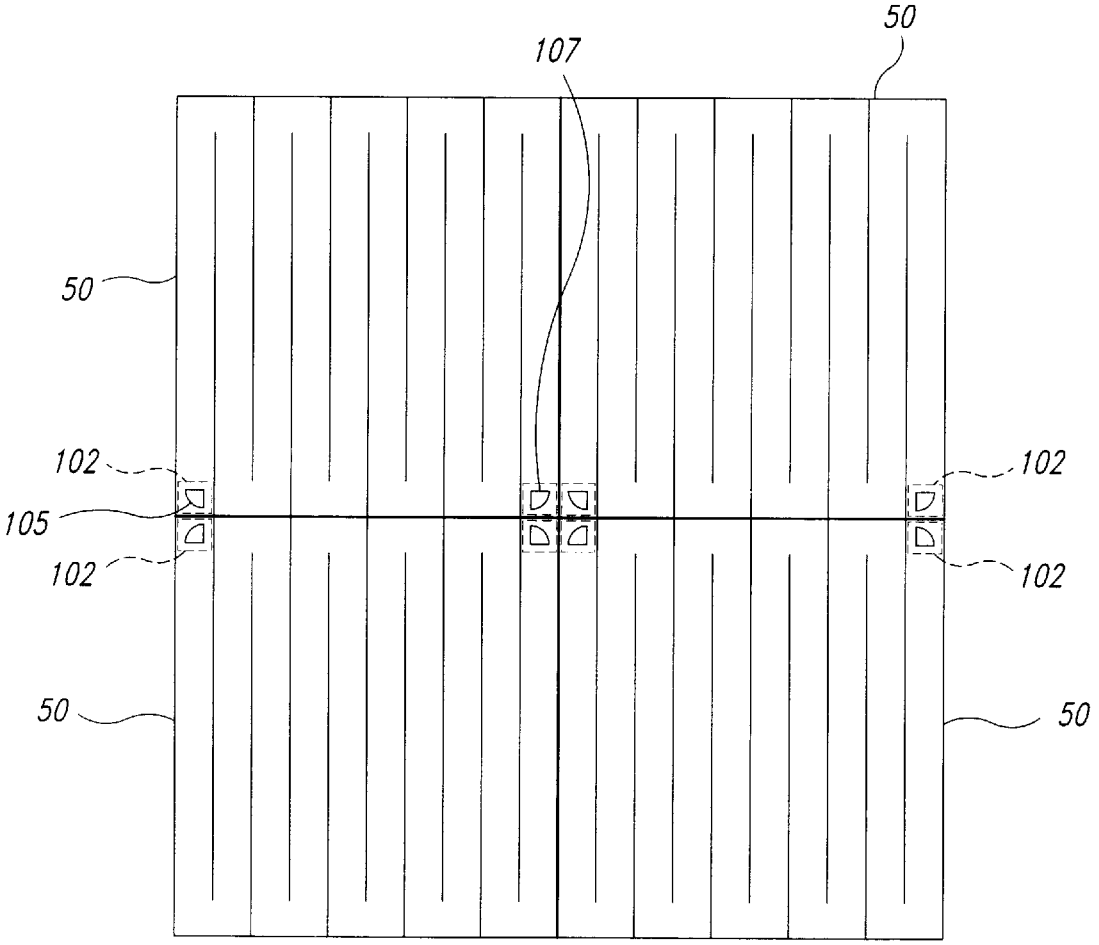
FIG. 8 is a top plan view of multiple lamps positioned adjacent each other.

FIG. 8 illustrates a two-by-two matrix of lamps 50.

Figure 3:
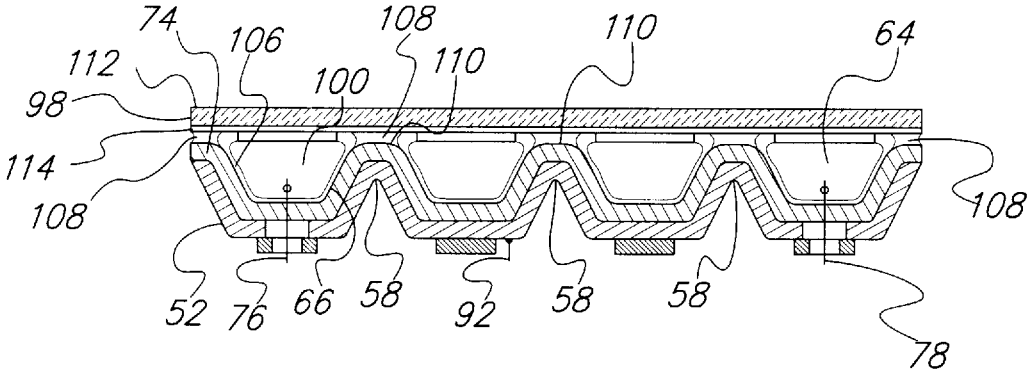
FIG. 3 is a representational cross section of a second alternative embodiment of the invention.

FIG. 3 presents a representational cross section of a lamp 50 according to the embodiment of FIGS. 1A and 1B having only four channel sections with several elements being shown in exaggerated scale to permit improved clarity of presentation. For further clarity, only four sections of the lamp 50 are shown rather than the 10 channel sections of the embodiment of FIGS. 1A–2C. It will be understood by those skilled in the art that the number of channel sections 64 may be varied greatly without departing from the scope of the invention.

As discussed above, the reflective, insulative coating 74 preferably overlays the entire upper surface 68 of the base 56, the sidewalls 54 and the ridges 58. The reflective, insulative coating 74 causes the inner surface 66 of the sections of the sidewalls 54 and exposed surfaces of the gaps 62 to be highly reflective and insulative, thereby reflecting any light within the enclosure 100 and providing electrical insulation of the enclosure 100 from the lamp body 52.

The reflective, insulative layer 74 is preferably a very thin, uniform, pinhole-free coating. Such thin uniform coatings may be achieved through electrocoating techniques such as electrophoresis, though other coating techniques such as chemical vapor deposition, dipping, and spray coating are also within the scope of the invention. As discussed below, the uniformity and pinhole-free structure achieved with such techniques can be improved by reflowing the layer 74 after coating. It has been determined that thin, uniform coatings are less likely than relatively thicker and/or non-uniform coatings to be damaged through flexure of the lamp body 52 which may occur through a variety of operational conditions. For example, thermal cycling of the lamp 50 may cause an expansion or contraction of the lamp body 52 due to the thermal coefficient of expansion of the metal forming the lamp body 52 or due to thermal expansion of the cover 98 which stresses the sidewalls 54. Also, in some applications, the lamp 50 may be subjected to vibration or impact causing some deformation of the lamp body 52. A uniform, pinhole-free coating is further advantageous, as pinholes or other gaps in the insulative layer 74 can disadvantageously provide a shortcut for the plasma arc by providing a path to the metal lamp body 52.

The fluorescent material 106 covers the reflective, insulative layer 74 throughout the enclosure 100. As shown, the fluorescent material 106 may also coat the lower surface of the cover 98. Where the fluorescent material coats the layer surface of the cover 98, it may be patterned according to a desired pattern. Such a patterned coating allows the light to be emitted in a specific pattern from the lamp. The cover 98 is preferably bonded to the lamp body using a clear glass solder bead 108 which preferably forms the contiguous seal 101 around the entire circumference of the lamp body and also seals the tops of the ridges 58 to the cover 98.

As shown in FIG. 3, the fluorescent material 106 does not pass underneath the glass solder bead 108. This is advantageous because it helps to prevent shortcutting of electrical energy across the ridges 58. That is, if a continuous layer of the fluorescent material 106 is permitted to form under the glass solder bead 108, it may provide a slightly conductive path or "shortcut" between adjacent sections over the intervening ridge 58. The effective discharge length between the electrodes 76, 78 would thereby be reduced. As is known in the art, the path length of electrical energy between electrodes strongly influences efficiency. By reducing the effective discharge length, shortcutting thus reduces the overall efficiency of the lamp 50 as is known in the art. Moreover, because some of the electrical energy will not travel along the entire length of the channel sections 64, portions of channel sections 64 adjacent the shortcut will appear darker, reducing the uniformity of light produced by the lamp 50. This problem is prevented in the present invention by the glass cover 98, the glass solder bead 108 and the ceramic glass coating 78 which together form an insulative barrier between adjacent sections 64. This barrier advantageously reduces the above-described problem of shortcutting, improving uniformity and efficiency of the lamp 50.

The cover 98 is transparent to visible light to maximize the light energy emitted from the lamp 50. In the embodiment of FIG. 3, the cover 98 preferably reflects ultraviolet light back into the enclosure 100 to increase the efficiency of the lamp 50 as described below. To improve the transmissivity of the cover in the visible range and to improve its reflectivity in the ultraviolet range, the cover 98 includes an optically transparent layer 112 and a dichroic coating 114. The optically transparent layer 112 is typically of a thin film glass material chosen to transmit light in the visible range while absorbing or reflecting light in the ultraviolet range. The dichroic coating 114 may be of a commercially available material selected to transmit light at the desired output wavelength of the lamp (typically, visible light) while reflecting light at other wavelengths (e.g., ultraviolet) back into the enclosure 100. The dichroic coating 114 may be applied using a number of known methods. As discussed below, the optically transparent layer 112 and dichroic coating 114 may be chosen with different optical properties for specific applications, such as infrared light generation. Additionally, while the coating is described as a dichroic coating 114, other wavelength selective overlays such as known semiconductor-based coatings may be used alternatively.

A thermal control element 115 is bonded to the lower surface of the lamp body 52 in a known manner such as a thermally conductive ceramic metal (cermet) solder or epoxy. The thermal control element 115 may be a heat sink to prevent overheating of the lamp, or may be a heating element to permit additional heat to be added. A heat sink for the thermal control element 115 is desirable in high output, continuous operation environments where the temperature of the lamp 50 may become undesirably high. A heating element for the thermal control elements 115 may be particularly advantageous for cold environment operation to warm the lamp 50, including the electrodes 76, 78, to reduce problems associated with cold-starting fluorescent lamps. Alternatively, both a heat sink and a heating element may be used together to provide a broader range of temperature control than that provided by a single thermal control element. Where a heat sink is desired it may be formed integral to the lamp body during the stamping process as a fin or multiple fins forced in the metal lamp body, as described below. Such finned structures for heat dissipation are well known. Where a heater is used, it can be printed on the backside of the lamp body 52 and be patterned into a sinuous resistive network, mirroring the serpentine channel design. The conductor film works effectively when applied by thick film by way of a solid state bond, electrically insulated from the metal substrate by insulative film 115A.

Figure 4:
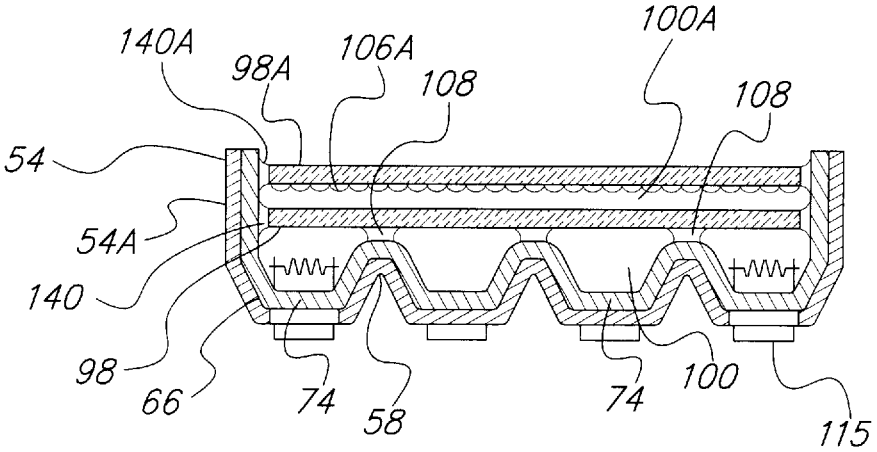
FIG. 4 is a cross-sectional view of a third alternative embodiment.

FIG. 4 presents an alternative embodiment that advantageously permits the separation of the phosphor layer from the enclosure 100. This embodiment is structured similarly to the previous embodiments, except as discussed hereinafter. In this second alternative embodiment, the cover 98 is positioned below the top of the sidewalls 54 and held in place by a solder glass bead 140 which forms a rigid bond between the cover 98 and the sidewall 54. A second cover 98A is positioned above and substantially parallel to the cover 98. The second cover 98A is held in place by a second solder glass bead 140A which forms a rigid bond between the sidewalls 54 and the second cover 98A. A second enclosure 100A is thus formed by the cover 98, the second cover 98A and a portion 54A of the sidewalls 54.

In this embodiment, the fluorescent material 106A is within the second enclosure 100A and is thus held separate from the mercury vapor 138 in the enclosure 100 by the cover 98.

The separation of the fluorescent material 106A (which typically contains phosphor) from the mercury vapor 138 advantageously reduces problems associated with the presence of phosphor within the enclosure 100. For example, because no phosphor is within the enclosure 100, the known problem of phosphor migration is eliminated. That is, no phosphor ions can migrate through the glass solder bead 108 to provide conduction between adjacent channels 64. This reduces the effects of shortcutting as described above.

Additionally, the fluorescent material 106A does not coat the lower surface of the cover 98. The phosphor will thus not affect the optical properties of the first cover 98. This, in turn, permits the selection of desired optical properties for the cover 98 and the second cover 98A. In this embodiment, the cover 98 is preferably chosen to be a glass which is highly transmissive in the ultraviolet range and highly reflective in the visible range. This permits ultraviolet energy produced within the enclosure 100 to pass efficiently into the second enclosure 100A where it can strike the fluorescent material 106A. However, visible light emitted downwardly by the fluorescent material 106A strikes the cover 98 and is reflected upwardly to be emitted by the lamp 50.

The second cover 98A is preferably chosen to be of a material that is transmissive at the desired output wavelength (e.g., visible light) of the lamp 50 and highly reflective at ultraviolet wavelengths. This permits light generated when the fluorescent material 106A is struck by ultraviolet light to be emitted from the lamp, while ultraviolet light is reflected back into the enclosure 100 where it is reflected by the reflective, insulative coating 74, back toward the fluorescent material 106A to generate additional fluorescent light.

Figure 5A:
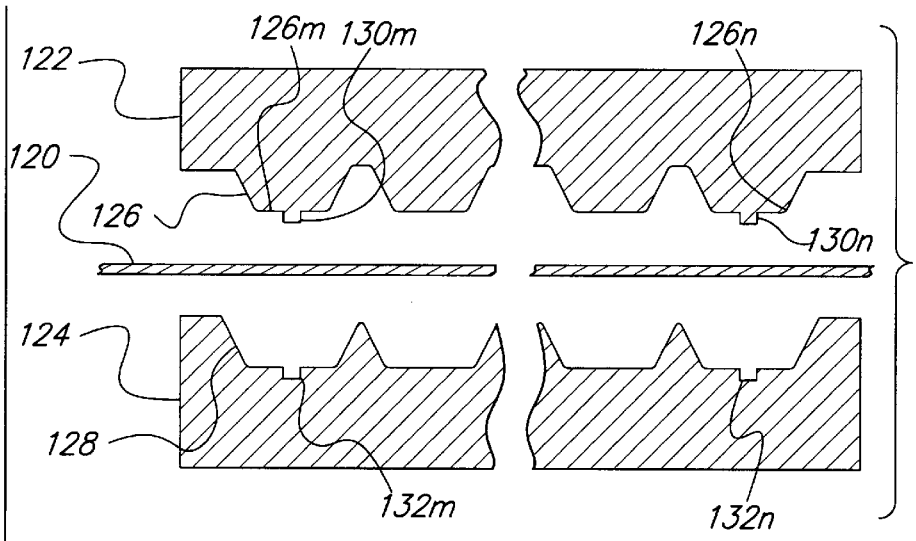
FIGS. 5A–F are representative drawings of the various stages of the inventive method of producing a planar lamp.
Figure 5B:
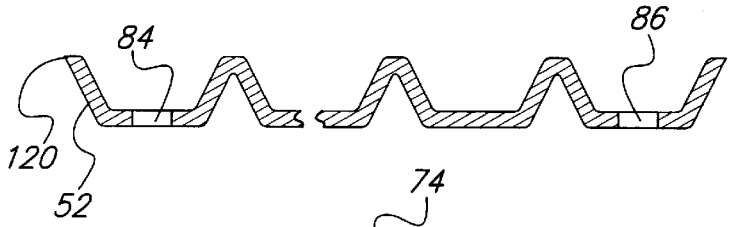

The lamp 50 is produced according to the following method. A single, planar sheet of metal 120 is provided. As shown in FIGS. 5A–F, the lamp body 52 is produced from the single sheet of metal 120 using known metal stamping and coating techniques. The sheet of metal 120 is initially positioned between a pair of complementary die 122, 124 having matched protrusions 126 and depressions 128. Each of the outermost protrusions 126 has a corresponding cylindrical punch 130 which mates to a respective hole 132 in the lower die 124. When the upper die 122 is pressed to the lower die 124, the metal 120 is shaped to form the lamp body 52 having apertures 84, 86 formed by the punches $\mathbf{130}_m$, $\mathbf{130}_n$ as shown in FIG. 5B. Excess metal may be eliminated or prevented using known techniques such as casting, or laser fabricating, or may be eliminated by forming cutting edges on the die 122, 124, as is known.

Figure 5C:
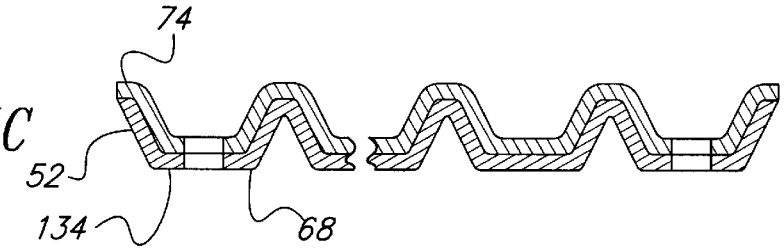

A layer 74 is then formed over the lamp body 52 by coating, as shown in FIG. 5C, with the reflective, insulative coating of a known material such as a reflective porcelain enamel, a silicon dioxide film or another diamondlike coating. The layer 74 is applied with an appropriate dense coating technique, such as electrophoresis, chemical vapor deposition, dipping or spray coating. If the technique used results in the layer 74 extending to the lower surface 134 of the base 56, the excess coating is removed at selected locations using mechanical, chemical or optical (laser) techniques to provide access for connection of the third electrode 92 and/or the thermal control element 115 to the base 56. After the reflective layer 74 is applied and buffed to remove undesired material, the reflective, insulative layer 74 is reflowed to remove defects and form an unbroken, pinhole-free surface. To reflow the deposited layer 74, the reflective, insulative coating is heated to approximately its melting temperature and cooled slowly and controllably. For example, the lamp may be cooled from a typical reflow temperature of about 780° C. for porcelain enamel to room temperature over a period of about four hours using a commerically available conveyorized furnace. This eliminates crystalline deformations formed during the coating process, thereby improving the homogeneity and uniformity of the insulative layer 74. The reflow process increases the density of the glass layer 74, providing the advantage that it has fewer pinholes or other discontinuities that could otherwise provide a short-circuit pathway to the metal body 52. This results in being able to construct a more reliable, error-free lamp using a thinner layer 74 than would be possible with the same glass, but without the reflow technique. This technique is thus particularly advantageous to provide a dense, uniform, yet relatively thin glass layer 74 for use as an insulative barrier in a flat fluorescent lamp.

Figure 5D:
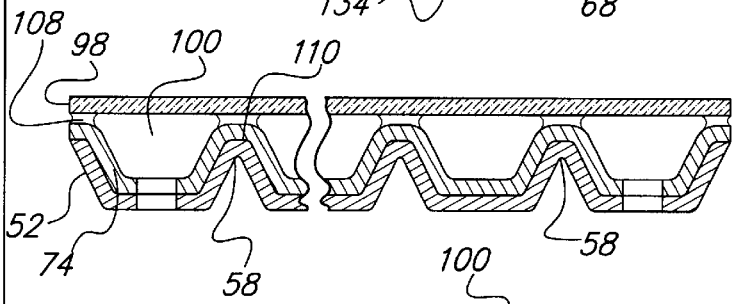

As shown in FIG. 5D, a glass solder bead 108 is deposited along the top of the already-coated sidewall 54 and atop the already-coated ridges 58. The glass solder bead is formed using a glass having a lower melting point than the material of the reflective insulative coatings. The cover 98 is then positioned over the lamp body 56, in contact with the glass solder bead 108. The glass solder bead 108 is then melted to form a continuous bond between the cover 98 and the reflective, insulative coating 74 along the top of the sidewalls 54 and the ridges 58. Because the glass solder bead 108 has a lower melting temperature than the reflective insulative layer 74, this heating of the glass solder bead to form the bond advantageously does not affect the reflective insulative layer. The lamp body with the cover bonded thereto forms an enclosure 100 having openings only at the apertures 84, 86.

Figure 5E:
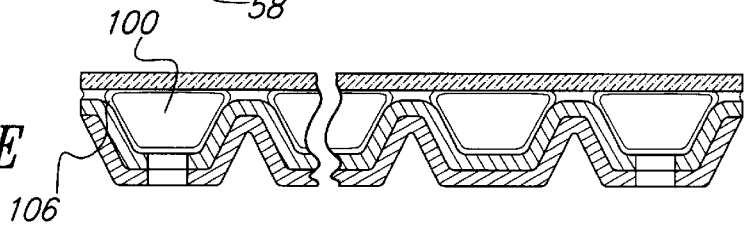

As shown in FIG. 5E, the inner surfaces of the enclosure 100 are coated with the fluorescent material 106 by drawing a phosphor-containing slurry through the enclosure 100 along the passageway 69 from one aperture 86 to the other aperture 84 using standard suction techniques or by injecting the slurry in one aperture 86 and forcing it through the enclosure 100 along the passageway 69 to the other aperture 84. In another alternative, the interior of the lamp body 52 is coated before the cover is attached and a serpentine pattern of fluorescent material 106 is formed on the cover 98 using known printing techniques. The lamp 50 is then heated to deposit the fluorescent material 106 throughout the enclosure 100. As is known, during the heating of the slurry, the reflective, insulative coating 74 is heated to a temperature where it softens and becomes sticky, but below a temperature where glass may cause degradation of the phosphor.

Figure 5F:
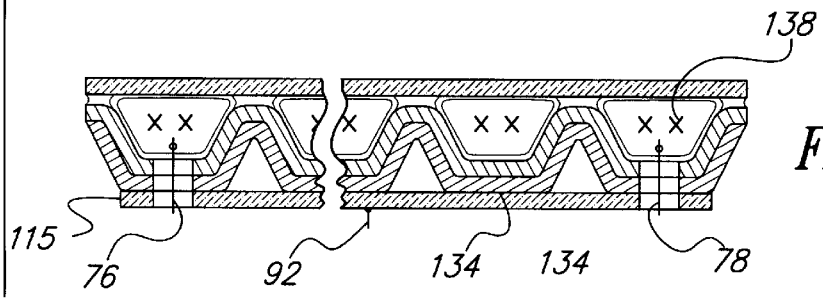

As shown in FIG. 5F, the thermal control element 115 is attached to the lower surface 134 of the base 56 in a known manner. The electrodes 76, 78 are then inserted in the apertures 84, 86 and bonded in place using an insulative material, such as a glass solder. The electrode 92 is then electrically connected to the lamp body, by direct attachment to the lamp body 52. The electrode 92 is held in place and the electrical connection is achieved through a known technique such as soldering, binding by pin and socket or by card edge connection.

Figure 6A:
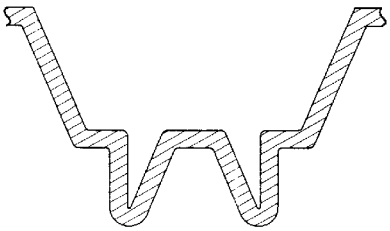
FIGS. 6A–E are cross-sectional views of sections of various alternative shapes of the serpentine channel.

Alternatively, additional heat dissipation capability can be formed integral to the lamp body 52 by forming fins 57 projecting outwardly from the lamp body 52, as shown in FIG. 6A. Such fins are known to provide an increased surface area to permit circulating air to dissipate heat more efficiently. As is known in the art, an operative fluorescent lamp requires a source material, typically mercury vapor, within the enclosure 100. In the preferred embodiment, mercury vapor 138 is inserted in the enclosure 10 through a small hole 140 (shown in FIGS. 1A and 2A). The aperture is then sealed using known techniques, such as a glass solder. To reduce the detrimental effects which might occur if oxygen is present within the enclosure 100, the mercury vapor is inserted through the hole 140 in the presence of a noble gas, such as argon, under a predetermined pressure and the lamp 50 is sealed before it is returned to the atmosphere. Typically, the predetermined pressure established within the enclosure 100 is below atmospheric pressure. The difference in pressure between the interior of the lamp 50 and the surrounding atmosphere places the lamp body 52 under a slight tension which has been determined to provide desirable relief from environmental effects, such as temperature increases.

In an alternative to the above-described method, the steps of coating the enclosure 100 with the phosphor containing slurry and baking out of the slurry are performed prior to the addition of the glass solder bead 108 and attachment of the cover 98. In this alternative method, the slurry is applied directly to the walls of the serpentine channel 60 and baked out, rather than using a vacuum or injection technique. The glass solder bead 108 is then applied to the perimeter of the lamp body 52 and the tops 110 of the ridges 58.

This alternative method is advantageous in that it prevents solid state migration of phosphor ions from the fluorescent material into the glass solder as the lamp 50 is heated during the baking out of the slurry. A phosphor-free glass is desirable because phosphor within the solder glass 108 may provide a conductive path between adjacent channel 64 effectively reducing the overall length of the serpentine channel by providing a shortcut in a similar manner to that described above, thereby reducing the efficiency of the lamp 50. Such solid state migration detrimentally creates a localized graying effect due to the presence of the slightly conductive path between adjacent panels.

In a second alternative embodiment of the inventive method, a further layer of glass containing lead may be deposited over the interior walls of the enclosure 100 prior to the attachment of the cover 98 and insertion of the slurry. The lead containing glass may be deposited in a known manner such as common deposition techniques. Such glasses containing lead are known to reduce the problem of migration of ions, such as phosphor ions from the fluorescent material, through the glasses in the lamp. In addition to preventing solid state migration of phosphor ions as described above, the lead containing glass is also useful to limit solid state migration through the glass of sodium and potassium ions which are inherent in many glasses.

The operation of the inventive device will now be described with reference to FIGS. 1A and 1B. In operation, the mercury gas 138 within the enclosure 100 is excited along the length of the passageway 69 by the electrodes 76, 78 according to known principles of fluorescent lamps. This major discharge arc is controlled between the electrodes 76, 78 for low to full brightness (+15K foot Lamberts). Other times, as in backlighting of avionic instruments during night flying, the secondary electrodes formed by the transparent conductive layer 14 and the lamp body 52 may be used independently. In order to have a large dynamic range of light, the lamp must be able to be dimmed below 1 foot Lambert and still hold a uniform discharge. This is virtually impossible utilizing the major arc electrodes 76, 78 only. Conversely, a combination of the electrodes 76, 78 and the secondary electrodes can be used for controlled dimming operations up to approximately 50 fL. This effectively produces a diffused plasma throughout the serpentine channel even at lower current levels used below approximately 500 fL. The mercury gas emits light when excited, primarily in the ultraviolet range, although some visible light energy is also produced. As is known in the art, the light energy from the mercury plasma radiates in all directions from approximately the center of the passageway 69 as viewed in cross-section. The radiated light energy from the mercury strikes the fluorescent material 106 which, in response, emits visible light. The visible light is then emitted through the transparent cover 98 toward an observer.

Providing a highly reflective inner surface 66 of the serpentine channel 60 due to the reflective, insulative layer 74 advantageously improves the efficiency of the conversion of ultraviolet light to visible light. Some of the impinging ultraviolet light energy from the excited mercury vapor is not converted by the fluorescent material 106 to visible light, because the process of conversion is not 100% efficient. In the inventive lamp 50, light emitted from the mercury gas and not converted to visible light is reflected back into the enclosure by the reflective layer 74 where the light may once again strike the fluorescent material 106, rather than being lost through absorption in the lamp body 52. Thus, some of the unconverted light emitted from the mercury gas is reflected to generate additional visible light, thereby improving the overall efficiency of the lamp 50.

Because the base 56 of the lamp 50 is formed using metal stamping techniques, the inner surface 66 of the serpentine channel 60 have almost any cross-sectional shape by machining the appropriate complementary die 122, 124.

Figure 6B:
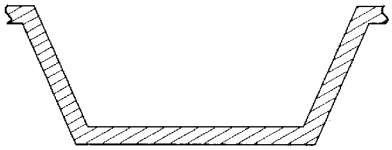
Figure 6C:
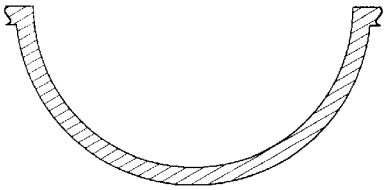
Figure 6D:
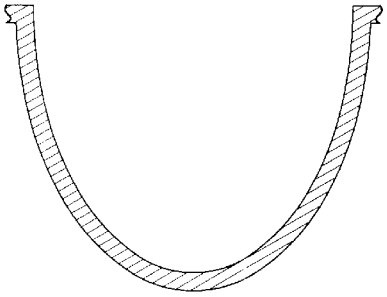
Figure 6E:
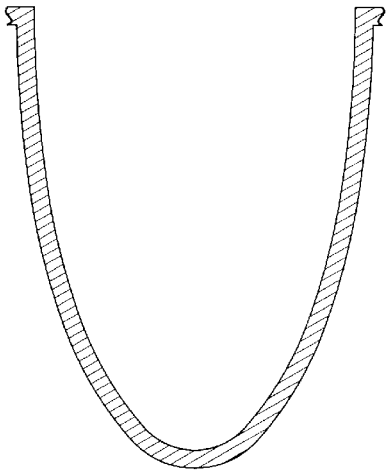

Shown in cross-section in FIGS. 6A–E are alternative cross-sectional views of sections 64 of the serpentine channel 60, including a finned section, a section formed from flat planes, an arcuate section, a shallow parabolic section and a steep parabolic section, respectively. As discussed above, the finned section of FIG. 6D improves heat dissipation. The flat planar cross-section of FIG. 6B is easily fabricated and provides a substantially planar base, to which the thermal control element 115 may be bonded easily. The shallow parabolic section of FIG. 6D, as is known, reflects light generated near the focal point of the parabola and directs it outwardly toward an observer. The steeper parabolic shape of FIG. 6E may be used to focus ultraviolet light energy on specific regions containing fluorescent material (e.g., the lower surface of the cover 98). This increases the probability that ultraviolet light within the passageway 69 which strikes the inner surface 66 and is reflected rather than converted to visible light will re-strike the fluorescent material and generate light. The arcuate section of FIG. 6C is also relatively easily fabricated and, because it will not typically have a specific focal point, as is known, can provide a smeared, more even light distribution than the parabolic sections of FIGS. 6D and 6E. While the shapes shown in FIGS. 6A–6E are advantageous in certain instances, other shapes which direct light toward an observer may be chosen without departing from scope of the invention.

The operation of the lamp 50 as described above presumes hot cathode operation. That is, when the mercury vapor is excited to a plasma arc state, the lamp 50 generates a relatively high level of light energy. To do so, however, the electrodes 76, 78 must be heated to a temperature in the range of 1000° C. While this type of operation is useful for many applications, it is often desirable to operate lamps such that they produce a lower light level. For example, such low level operation may be particularly useful for applications such as nighttime illumination of instruments or other low light applications.

In hot cathode operation as described above, it is very difficult and inefficient to operate the lamp 50 at low light levels. This occurs in part because sufficient energy must be input to the electrodes 76, 78 to heat them to the 1000° C. range. In low light operation, this requires the addition of a heating element to raise the temperature of the electrodes 76, 78. Further, hot cathode operation of fluorescent lamps at low light levels is known to cause degradation of the electrodes over time through sputtering away of the electrode material.

A known alternative to hot cathode operation of fluorescent lamps is cold cathode operation. In cold cathode operation, a third electrode having a large surface area is employed. The third electrode operates at a temperature around 150° C. and provides electrons by field emission, also called secondary electron emission. Cold cathode operation is advantageous because light energy at low light levels is known to be produced more efficiently by cold cathode operation. This improved efficiency is achieved in part because cold cathode operation generally requires no heater to operate at low light levels. For more detailed description of hot and cold cathode operation. See Miller, H. A., "Cold Cathode Fluorescent Lighting," *Chemical Publishing,* 1979.

The present invention can generate light through cold cathode operation by the use of the cold cathode electrodes 119, 121 as shown in FIGS. 1A and 1B. In combination, hot cathode and cold cathode capabilities provide high light intensity capability along with high dimmability, as described in U.S. Pat. application Ser. No. 07/816,034. The lamp 50 thus becomes a source of extremely uniform, low intensity light, useful in low light situations without degrading the major arc electrodes 76, 78 and a source of high intensity light useful in high ambient light environments.

Further improvement in the operation of the lamp is achievable through control of electric fields within the lamp by controlling the voltage applied to the secondary terminal 92. The secondary terminal 92 allows the entire lamp body 52 to be referenced to a known potential or driven by a second input source, effectively converting the lamp body 52 to a third electrode or ground reference. In the preferred embodiment, the lamp body 52 operates using field emission effect. This is the same phenomenon applied in cold cathode operation. See Miller, H. A., "Cold Cathode Fluorescent Lighting," *Chemical Publishing,* 1979. However, the present invention contemplates that this effect may be used independently of, or in conjunction with, typical cold cathodes. Therefore, to distinguish the effect produced by the use of a portion of the lamp body 52 (or, as described hereinafter, a portion of the lamp cover 98) as an electrode from typical cold cathode operation; the effect will be referred to herein as a secondary electrode effect. Because the entire lamp body 52 is used as a secondary electrode, electrons may be emitted throughout the lamp and light may thus be produced at any point along the upper surface 67 of the base 56 or along the sidewalls 54. Thus, the secondary electrode effect, when combined with hot cathode operation, produces light relatively uniformly throughout the enclosure 100.

The secondary electrode effect also permits the electric field intensity to be controlled throughout the lamp 50. The electric field caused by the secondary electrode can be used to spread the mercury vapor discharge more evenly in the lamp 50, improving uniformity of light produced by the lamp 50.

Figure 7:
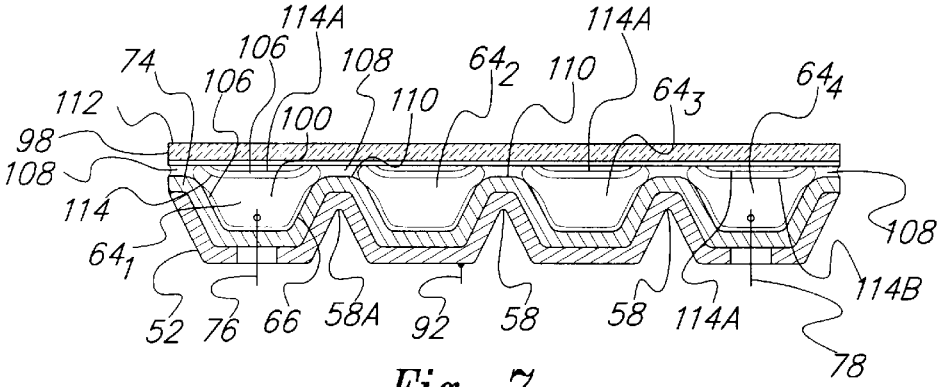
FIG. 7 is a representational cross-section of a fourth alternative embodiment of the invention.

In an alternative arrangement employing the secondary electrode effect, a layer of a transparent conductive coating 114A such as indium tin oxide is formed beneath the dichroic coating 114. Such materials are known in the art. As shown in FIG. 7, the transparent conductive coating 114A preferably covers a central portion of the lower surface of the lamp cover, and follows the serpentine path.

In this alternative embodiment, the transparent conductive coating 114A is electrically connected to the lamp body 52 in a known manner, such as by attachment of a conductive lead between the transparent conductive coating 114A and the lamp body 52. This embodiment is particularly advantageous because it enables the secondary electrode effect to be applied in almost any direction via the plasma discharge through the serpentine channel 60 from any or all the lower surface 66 of the base 56, the sidewall 54, and the lower surface of the lamp cover 98. An insulative coating 114B over the transparent conductive coating 114A advantageously prevents the transparent conductive coating 114A from providing a relatively low impedance path directly between the electrodes 76, 78 as compared to the path through the light producing gas. The insulative dichroic coating 114B also prevents the indium tin oxide from being sputtered away. The transparent conductive coating 114A is patterned into a serpentine, matching the metal stamped serpentine and provides improved control of the electric field and temperature within the chamber. If an AC field is applied between transparent conductive coating 114A and the lamp body 52, it produces a secondary plasma discharge, which in turn intensifies the primary arc discharge. While the conductive transparent coating 114A is shown as covering substantially the entire serpentine channel, it will be understood by those skilled in the art that other configurations, such as linear strips of conductive transparent coating 114A along each of the sections 64, are also within the scope of the invention. Choosing different structures for the transparent conductive coating advantageously allows electric fields generated by the secondary electrodes to be modified to thereby modify the shape of the plasma discharge.

Cold cathode operation may be used in conjunction with hot cathode operation, to generate a uniform low light level in addition to the less uniform higher light level produced through hot cathode only operation. The cold cathode effect helps to create a more uniform over lighting effect for the lamp by providing some light in those regions, such as at corners, where hot cathode operation is known to leave "dark" regions. This permits the illumination to be permitted across the entire lamp allowing lamps to be positioned side-by-side in a tiled matrix to produce light uniformly over a large area.

The use of secondary electrodes in conjunction with hot cathode operations advantageously allows control of the electromagnetic fields through which the plasma arc passes. For example, the transparent conductive coating 114A may be connected to one terminal of a power source with the lamp body connected to a second terminal of the power source. If the power source is separate from the input to the electrodes 76, 78, such as a separate AC power supply, the electric fields transverse to the direction of the plasma arc and can be generated and controlled.

Because the electromagnetic fields in the region of the plasma arc can affect the distribution of light generated by the plasma discharge, the distribution of light in the lamp 50 can be altered by applying power to the secondary electrodes. This effect is particularly advantageous at the gaps 62 between adjacent channel sections 64 where the effect permits the plasma discharge to be altered to reduce uniformity caused by the turn.

As is known, the electric field between electrodes is affected significantly by the relative position and shape of the electrodes. Thus, the effect of the transparent conductive coating 114A may be adjusted by selection of appropriate structures for the transparent conductive coating 114A, such as narrow linear strips.

While the above embodiments presume that the lamp 50 is to be used for visible light creation, through the selection of appropriate materials the lamp 50 may also be used for generation of light in the ultraviolet or infrared regions according to known techniques. For example, if the dichroic coating 114 is chosen to permit the passage of ultraviolet light while reflecting visible and infrared light back into the enclosure 100, the lamp may be used as an ultraviolet light source. Once again, selection of the proper materials for the reflective insulation coating 74 and for the cover 98. Such lamps might be useful in medical and other applications where the ultraviolet light provides an inhibitive effect upon the growth of pathogens.

Similarly, if the fluorescent coating is chosen to emit light in the infrared range and dichroic coating 114 is selected to permit emission of only the infrared light generated by the fluorescent coating, and to reflect ultraviolet and visible light back into the enclosure, the fluorescent lamp may be used as an infrared light source. The selectivity and efficiency of such infrared operation may be improved further by selecting the reflective, insulative coating 74 to have a wavelength selective reflectivity and by selecting a glass for the cover 98 that absorbs light in the visible and ultraviolet ranges. Infrared lights of this type are particularly useful in certain nighttime applications, such as night vision technology.

In a similar fashion, the coating 114 may be chosen such that the lamp 50 can be made to produce light selectively in a given range of visible wavelengths. For example, the lamp may be used to produce solely red or blue light by providing a coating 114 that selectively passes only red or blue light of that specific phosphor wavelength.

The lamp is designed to have a maximum brightness greater than 15K fL, with a dynamic range down to less than 1 fL or a dimming ratio of 15000:1. This is only possible by maintaining a uniform and steady plasma discharge with an additional electromagnetic field suppressed against the major arc emissions. This additional electromagnetic field is supplied by the planar electrodes.

The invention has been described and illustrated with respect to various alternative embodiments. Variations of the alternative embodiments may be made within the scope of the invention. For example, while the preferred embodiment of the invention is generally rectangular, other shapes, such as circular cross-sections were known shapes for planar fluorescent lamps, and may be used without departing from the scope of the invention.

This description enables those skilled in the art to combine one or more of the features of one embodiment with other embodiments. For example, the embodiment including two enclosures may be utilized with the transparent conductive film to create a dual enclosure lamp with a cold cathode along the upper and lower surface of the first lamp cover.

Other features of the various embodiments could also be combined, as desired, without including all of the features of any one embodiment. Such a lamp would still fall within the scope of this invention. Additionally, equivalent structure may be substituted for the structure described herein to perform the same function in substantially the same way and fall within the scope of the present invention, the invention being described by the claims appended hereto and not restricted to the embodiments shown herein.

I claim:

1. A planar photoluminescent lamp, comprising:

a lamp body having first and second opposing endwalls, first and second sidewalls and a base;

a first plurality of internal channel walls extending from the first endwall and terminating a predetermined distance from the second endwall;

a second plurality of internal channel walls extending from the second endwall and terminating a predetermined distance from the first endwall, the first and second plurality of internal channel walls defining a serpentine channel having a channel length extending from a first end to a second end;

a lamp cover mounted to the lamp body such that the lamp body and the lamp cover seal the serpentine channel and thereby define a chamber;

first and second apertures in the lamp base proximate the first and second channel ends, respectively;

a first housing externally mounted outside of the chamber and mechanically coupled to the lamp base, the first housing having an interior portion in fluid communication with the chamber via the first aperture;

a first electrode mounted within the interior portion of the first housing;

a second housing externally mounted outside of the chamber and mechanically coupled to the lamp base, the second housing having an interior portion in fluid communication with the chamber via the second aperture;

a second electrode mounted within the interior portion of the second housing, the first and second electrodes producing a plasma discharge therebetween through the first and second apertures and along the channel length when supplied with electrical power;

a gas within the chamber to emit ultraviolet energy in response to the plasma discharge along the channel length; and a photoluminescent material within the chamber to produce visible light in response to the ultraviolet energy.

2. The lamp of claim 1 wherein a plurality of the lamp bodies are positioned adjacent to each other to form matrix.

3. The lamp of claim 1 wherein the first and second electrodes are a cold cathode type.

4. The lamp of claim 1 wherein the first and second electrodes are a hot cathode type.

5. A gas-filled photoluminescent planar lamp containing a photoluminescent material to emit visible light when the gas emits ultraviolet energy in response to a plasma discharge, the lamp comprising:

a lamp body having an interior portion;

first and second apertures in the lamp body;

a first housing externally mounted outside of the lamp body, the first housing having an interior portion in fluid communication with the lamp body interior portion via the first aperture;

a first electrode mounted within the interior portion of the first housing;

a second housing externally mounted outside of the lamp body, the second housing having an interior portion in fluid communication with the lamp body interior portion via the second aperture; and a second electrode mounted within the interior portion of the second housing, the first and second electrodes producing the plasma discharge therebetween through the first and second apertures when supplied with electrical power.

6. The lamp of claim 5 wherein the first and second housings are bonded to the lamp body form a seal between the housings and the lamp body.

7. The lamp of claim 5 wherein the first and second electrodes are a cold cathode type.

8. The lamp of claim 5 wherein the first and second electrodes are a hot cathode type.

9. The lamp of claim 5 wherein the lamp body includes first and second opposing endwalls, the lamp further including a first internal wall extending from the first endwall and terminating a predetermined distance from the second endwall and a second internal channel wall extending from the second endwall and terminating a predetermined distance from the first endwall to form a serpentine channel with first and second ends, the first aperture being proximate the first end of the serpentine channel and the second aperture being proximate a second end of the serpentine channel.

10. The lamp of claim 5 wherein a plurality of lamp bodies are positioned adjacent to each other to form a matrix.

11. The lamp of claim 10 wherein each of the plurality of lamp bodies in the matrix contains first and second ends, first and second apertures, first and second housings, and first and second electrodes, respectively.

12. A method for producing uniform lighting using a photoluminescent lamp to emit visible light in response to a plasma discharge, the method comprising the steps of:

providing a lamp body having an interior portion;

forming first and second apertures in the lamp body;

forming a first housing having an interior portion;

mounting the first housing outside of the lamp body wherein the first housing interior portion is in fluid communication with the lamp body interior portion via the first aperture;

mounting a first electrode within the first housing interior portion;

forming a second housing having an interior portion;

mounting the second housing outside of the lamp body wherein the second housing interior portion is in fluid communication with the lamp body interior portion via the second aperture; and mounting a second electrode within the second housing interior portion, the first and second electrodes producing a plasma discharge therebetween through the first and second apertures when supplied with electrical power.

13. The method of claim 12 wherein the steps of mounting the first and second housings include bonding the first and second housings to the lamp body to form a seal between the housings and the lamp body.

14. The method of claim 12 wherein the first and second electrodes are a cold cathode type.

15. The method of claim 12 wherein the first and second electrodes are a hot cathode type.

16. The method of claim 12, further including the steps of forming first and second opposing endwalls on the lamp body, forming a first internal wall extending from the first endwall and terminating a predetermined distance from the second endwall and forming a second internal channel wall extending from the second endwall and terminating a predetermined distance from the first endwall.

* * * * *